United States Patent [19]

Carruba

[11] Patent Number: 4,983,074

[45] Date of Patent: Jan. 8, 1991

[54] OFFSHORE SUPPORT STRUCTURE METHOD AND APPARATUS

[75] Inventor: Samuel C. Carruba, Houston, Tex.

[73] Assignee: CBS Engineering, Inc., Houston, Tex.

[21] Appl. No.: 351,439

[22] Filed: May 12, 1989

[51] Int. Cl.[5] ..... E02B 17/00; E02D 31/00

[52] U.S. Cl. ..... 405/227; 405/204; 405/224

[58] Field of Search ..... 405/227, 204, 202, 224, 405/195; 166/338, 350, 359, 367; 175/5-7

[56] References Cited

U.S. PATENT DOCUMENTS

| | | | |
|---|---|---|---|
| 3,516,259 | 6/1970 | Tokola | 405/208 |
| 3,546,885 | 12/1970 | Pogonowski | 405/227 |
| 3,624,702 | 11/1971 | Meheen | 405/227 |
| 3,670,507 | 6/1972 | Mott et al. | 405/227 |
| 4,679,964 | 7/1987 | Blandford | 405/227 X |
| 4,687,380 | 8/1987 | Meek et al. | 405/204 |
| 4,740,107 | 4/1988 | Casabarian et al. | 405/204 X |

OTHER PUBLICATIONS

*Offshore*, Nov., 1988, pp. 24-28, vol. 48, No. 11, "Minimal Platforms Provide Economic Relief".

Undated Drawing Entitled, "Seashark", Fig. 4.2.3-1.

*Primary Examiner*—Dennis L. Taylor

*Attorney, Agent, or Firm*—Ben D. Tobor

[57] ABSTRACT

A method and apparatus for offshore support structures utilizes a hollow pile disposed within one leg of a three-legged structure to support an offshore platform, wherein the hollow pile is fixedly secured to the tubular leg within which it is disposed.

8 Claims, 4 Drawing Sheets

OFFSHORE SUPPORT STRUCTURE METHOD AND APPARATUS

1. FIELD OF THE INVENTION

The invention relates to offshore support structure methods and apparatus for use with at least one well located in a body of water.

2. DESCRIPTION OF THE PRIOR ART

In the drilling of wells at offshore locations, many offshore structures have been provided which have platform structures mounted thereon to support various types of drilling units. Many of these offshore structures are exceedingly large, massive and expensive. Many wells are drilled at offshore locations from a jack-up drilling rig or a semi-submersible drilling rig, and after the drilling process has been completed, a platform structure supported by some sort of support structure is still necessary for the production of the hydrocarbons. These platform structures are likewise quite expensive. It is thus desirable to reduce the cost of offshore support structures, so that the cost of placing a well into production is minimized. It would then be possible that some less productive, or marginal, offshore wells could be placed into production of hydrocarbons.

One common design of offshore support structure is a tripod support structure wherein a central conductor, or pipe, extending from the ocean floor to above the water surface is supported by three skirt piles spaced about the central conductor, the three skirt piles each being interconnected to the central conductor by a plurality of braces, as well as a plurality of braces extending between the three skirt piles. In this tripod type of offshore structure, a platform structure may be supported by the central conductor, and a plurality of wells may be disposed within the large diameter central conductor. Typically, a jack-up drilling rig is used to drill the wells; however, because of the braces running from each of the three skirt piles upwardly to the central conductor, difficulties may be encountered in maneuvering in the water to a position adjacent the central column, whereby drilling operations can be carried out. Another disadvantage associated with this type of structure is that the central conductor cannot transfer axial and lateral loads directly into the ocean floor, but rather all axial and lateral loads are transmitted into the ocean floor by the three skirt piles, whereby stronger bracing of the central conductor is required.

Another type of offshore structure would be a conventional platform structure supported by three or more tubular legs, which are secured to the ocean floor by a plurality of piles, the plurality of legs all extending above the surface of the water, and all of the legs requiring that a plurality of piles be driven from above the surface of the water, downwardly through the pile legs into the ground beneath the body of water. This structure typically is quite massive and costly to manufacture, in that the upper ends of each of the legs is subject to the forces exerted by wave action upon each of the legs.

Accordingly, prior to the development of the present invention, there have been no offshore support structure methods and apparatus which: are simple and economical to manufacture and use; require a minimum number of piles to be driven into the ground beneath the body of water; have a smaller wave load due to a reduced surface area upon which the water acts; and more efficiently withstand axial loading.

Therefore, the art has sought offshore support structure methods and apparatus which: are simple and economical to manufacture and use; require a minimum number of piles to be driven into the ground beneath the body of water; have a smaller surface area upon which the water acts, thus reducing the wave loads; and more efficiently withstand axial loading.

SUMMARY OF THE INVENTION

In accordance with the invention, the foregoing advantages have been achieved through the present support structure for use with at least one well located in a body of water. The present invention includes three tubular legs, each leg having upper and lower ends, a first leg having a length longer than the depth of the body of water, and the upper end of the first leg is adapted to be disposed above the surface of the body of water, the second and third legs each having substantially the same length, which length is shorter than the depth of the body of water; a single pile disposed in each of the legs and adapted to be driven into the ground below the body of water, the pile disposed in the first leg being a hollow pile, having an upper and a lower end, extending outwardly and upwardly from the first leg and being fixedly secured thereto; a plurality of bracing members disposed between and interconnecting the three tubular legs; and the at least one well is disposed within the hollow pile disposed in the first leg, whereby the only portion of the support structure subject to the action of waves on the surface of the body of water is the upper end of the first leg, and the hollow pile disposed in the first leg becomes part of the support structure and is capable of withstanding lateral and axial loads exerted upon the support structure.

A further feature of the present invention is that a plurality of tubular guides may be disposed in a spaced relationship outside of, and along, the length of the first leg, whereby additional wells may be placed in the ground below the body of water. Another feature of the present invention is that a platform structure may be secured to the upper end of the hollow pile disposed in the first leg. A further feature of the present invention is that a platform structure may be secured to the upper end of the hollow pile disposed in the first leg. A further feature of the present invention is that a mud mat may be disposed adjacent the lower end of each leg.

In accordance with another aspect of the invention, the foregoing advantages have been achieved through the present method for installing a platform structure for use with at least one well located in a body of water. This aspect of the present invention includes the steps of: lowering a support structure to the ground beneath the body of water at a desired location in the body of water, the support structure having three interconnected tubular legs, each leg having upper and lower ends; disposing the support structure in the body of water with only the upper end of one tubular leg extending above the surface of the body of water; driving a single hollow pile, having upper and lower ends, through the tubular leg extending above the surface of the body of water and into the ground beneath the body of water, and driving a single pile through the other two tubular legs and into the ground beneath the body of water, which two legs have their upper ends disposed below the surface of the body of water; disposing the upper end of the hollow pile to extend outwardly and upwardly from the upper end of the tubular leg through which the hollow pile has been driven; fixedly securing the hollow pile to the tubular leg through which the hollow pile has been driven; and securing the platform structure to the upper end of the hollow pile, whereby the hollow pile becomes part of the support structure and is capable of withstanding lateral and axial loads exerted upon the support structure, and the only portion of the support structure subject to the action of waves on the surface of the body of water is the upper end of the leg containing the hollow pile and the upper end of the hollow pile.

A further feature of the present method is the step of drilling a well through the hollow pile. An additional feature of the present method includes the steps of disposing a plurality of tubular guides in a spaced relationship outside of and along the tubular leg which extends above the surface of the body of water; disposing a hollow pile through the tubular guides; and drilling a well through the hollow pile. An additional feature of the present method includes the step of disposing a mud mat adjacent the lower end of each tubular leg.

The offshore support structure methods and apparatus for use with at least one well located in a body of water of the present invention, when compared with previously proposed prior art offshore support structure methods and apparatus, have the advantages of: being simple and economical to manufacture and use; require a minimum number of piles to be driven into the ground beneath the body of water; present a smaller surface area upon which the water acts, whereby there are smaller wave loads; and more efficiently withstand axial loading.

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE INVENTION

Figure 1:
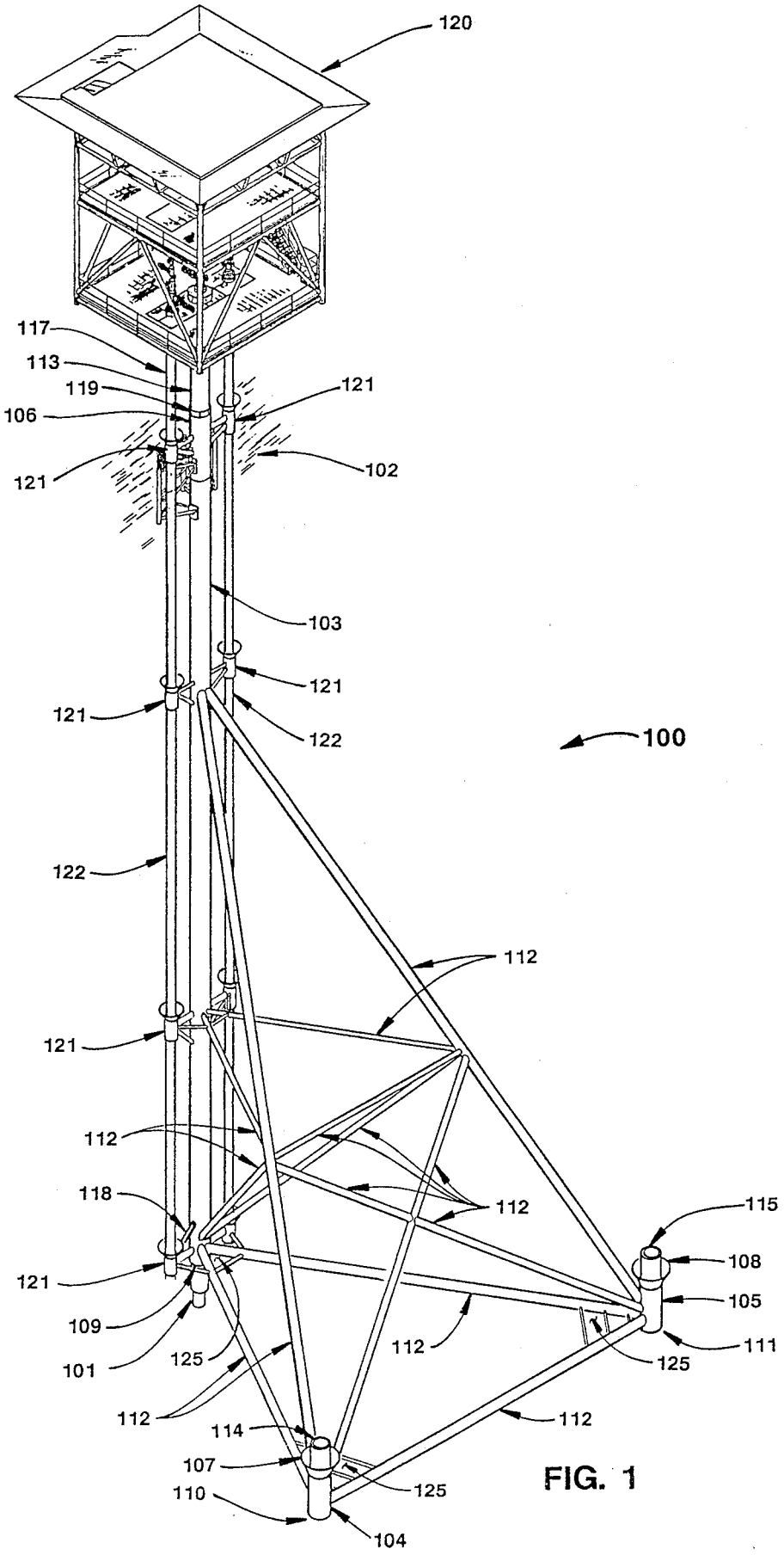
FIG. 1 is a perspective view of an offshore support structure in accordance with the present invention.
Figure 3:
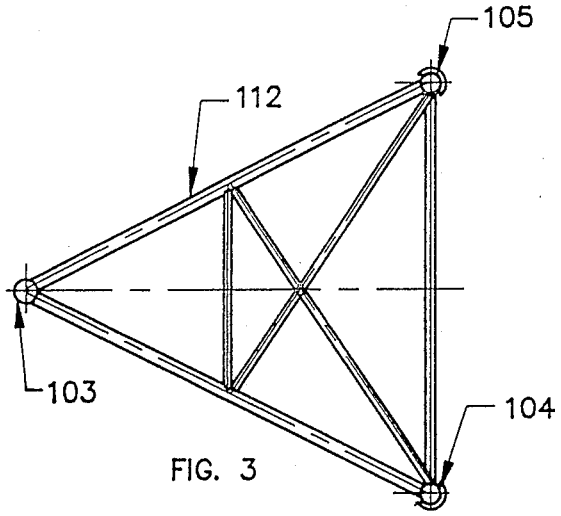
FIG. 3 is a top view of the support structure of FIG. 1.
Figure 2:
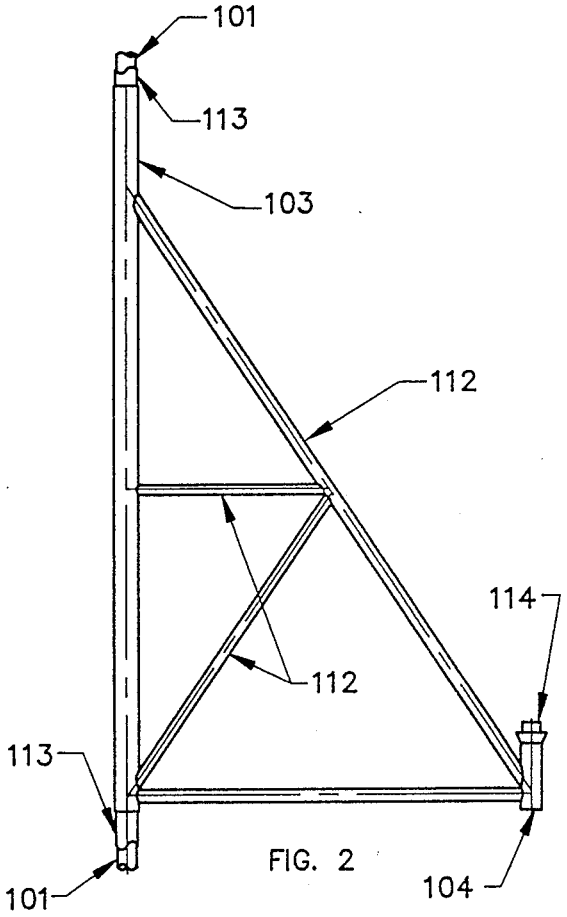
FIG. 2 is a side view of the offshore support structure of FIG. 1.
Figure 4:
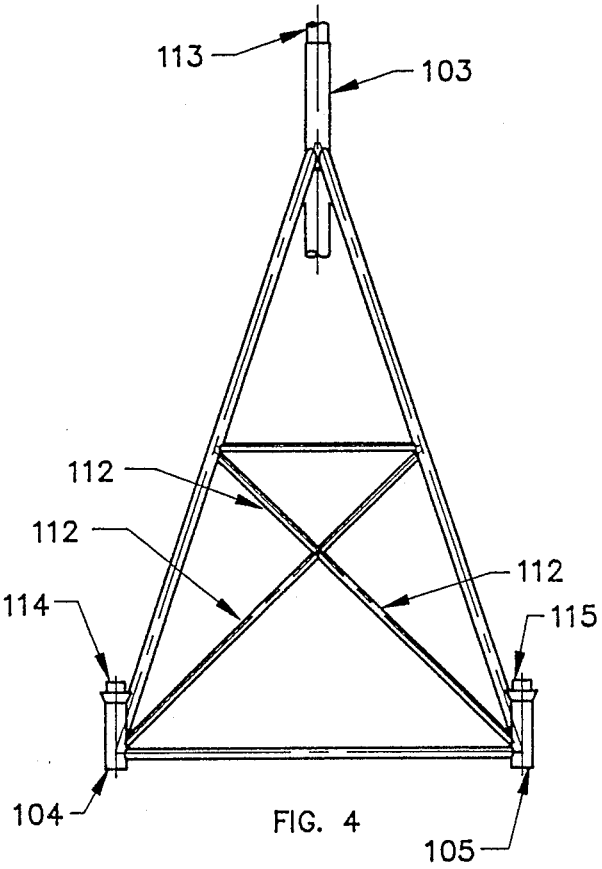
FIG. 4 is a rear view of the offshore support structure of FIG. 1.

With reference to FIGS. 1-4, an offshore support structure 100 in accordance with the present invention is shown for use with at least one well 101 located in a body of water 102. Support structure 100 generally comprises three tubular legs 103-105, each leg having upper ends 106, 107, 108 and lower ends 109, 110, 111. The first leg 103 of offshore support structure 100 has a length longer than the depth of the body of water 102, and as seen in FIG. 1, the upper end 106 of the first leg 103 is adapted to be disposed above the surface of the body of water 102. The second and third legs 104, 105, each have substantially the same length, which length is shorter than the depth of the body of water 102. A plurality of bracing members 112 are disposed between and interconnecting the three tubular legs 103-105, to provide rigidity to the support structure 100 formed by the three tubular legs 103-105. The bracing members 112 may be disposed between, and interconnecting the three tubular legs 103-105 in any suitable manner so as to provide the necessary support and rigidity to offshore support structure 100. It should be noted that preferably none of the bracing members 112 extends above the surface of the water 102, whereby the only portion of the support structure 100 which is subject to higher wave pressures is the upper end 106 of the first leg 103.

A single pile 113-115 is preferably disposed in each of the legs 103-105, and is adapted to be driven into the ground 116 below the body of water 102, in a conventional manner. The pile 113 disposed in the first leg 103 is preferably a hollow pile, or pipe, having an upper and a lower end 117, 118, the lower end 118 being driven into the ground 116 beneath the body of water 102 and the upper end 117 of the hollow pile 113 extending outwardly and upwardly from the first leg 103. (For drawing clarity, piles 113-115 are not shown in FIGS. 2-4.) Hollow pile 113 is preferably fixedly secured to the first leg 103 as at 119, as by welding hollow pile 113 to the upper end 106 of leg 103, or by a segmented sleeve, or conventional coupling, or in any suitable manner so as to provide a secure connection between the hollow pile 113 and first leg 103. After hollow pile 113 has been driven through first leg 103 into the ground 116 beneath the body of water 102, and after it has been fixedly secured to the first leg 103 in the manner previously described, hollow pile 113 thus becomes capable of not only withstanding lateral loads, but axial loads exerted upon the support structure 100, in that hollow pile 113 has become an integral part of support structure 100.

Piles 114 land 115 may be driven through legs 104 and 105 into the ground 116 in a conventional manner. After piles 114 and 115 have been driven into the ground 116, they may be fixedly secured to the legs 104 and 105 in a conventional manner, such as by use of segmented sleeves, couplings, or as by grouting. As seen in FIG. 1, a conventional platform structure 120 may be secured to the upper end 117 of the hollow pile 113 disposed in the first leg 103. Dependent upon the design and construction of the platform structure 120, wells, such as well 101 may be drilled into the ground 116 beneath the body of water 102, either before, or after production platform 120 has been secured to hollow pile 113. The wells, such as well 101, may be drilled in a conventional manner by a jack-up rig, or a semi-submersible drilling rig. Preferably, the at least one well 101 is disposed within the hollow pile 113 disposed in the first leg 103. If additional wells are desired, a plurality of tubular guides 121 may be disposed in a spaced relationship outside of, and along, the length of the first leg 103 as illustrated in FIG. 1. (For drawing clarity, the plurality of tubular guides 121 are not shown in FIGS. 2-4.) The additional desired wells, may be drilled directly into the ground 116, tubular guides 121 being used to guide the drilling equipment and necessary casing pipe. Alternatively, additional hollow piles 122, similar in construction and design to hollow pile 113, may first be passed through the tubular guides 121, and the desired wells then drilled through the additional hollow piles 122. As seen in FIG. 1, a mud mat 125 may be disposed adjacent the lower end of each leg 103–105 to prevent the lower ends of legs 103–105 from sinking into potentially soft ground 116 before the piles 113-115 can be driven through the legs 103–105.

With reference now to FIGS. 5–8, another embodiment of an offshore support structure 100' in accordance with the present invention will be described. The same reference numerals have been used for components of the offshore support structure 100' of FIGS. 5–8, which are identical to the components of the offshore support structure 100 of FIGS. 1–4, and primed reference numerals have been used for components which are substantially the same as those previously described. In general, offshore support structure 100' differs in construction from that of offshore support structure 100 in that legs 104' and 105' are longer in length than legs 104 and 105 and additional bracing members 112' are utilized. The offshore support structure 100' of FIGS. 5–8 is intended for use in bodies of water 102 having a depth of between 150 to 300 feet, and the offshore support structure 100 of FIGS. 1–4 is intended for use in waters having a depth of from 10 to 150 feet. Obviously, an additional difference between support structures 100' and 100, is that piles 114' and 115' likewise have a correspondingly greater length since they are intended for use with the longer legs 104' and 105'. Hollow pile 113' and leg 103' only differ in length from their corresponding counterparts illustrated in FIGS. 1–4. As will hereinafter be described in greater detail, the installation of support structures 100 and 100' is the same.

Figure 5:
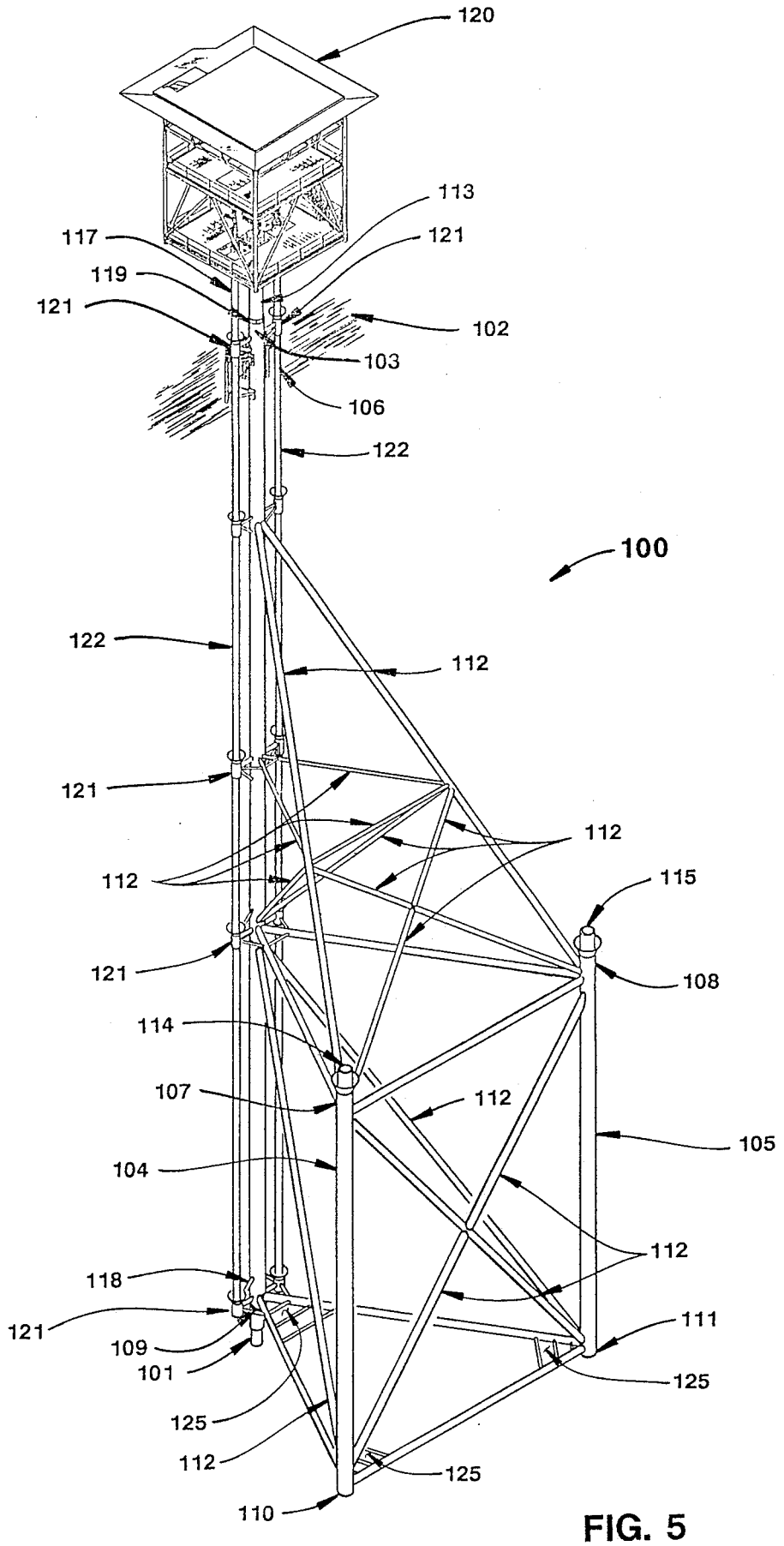
FIG. 5 is a perspective view of another embodiment of an offshore support structure in accordance with the present invention.
Figure 7:
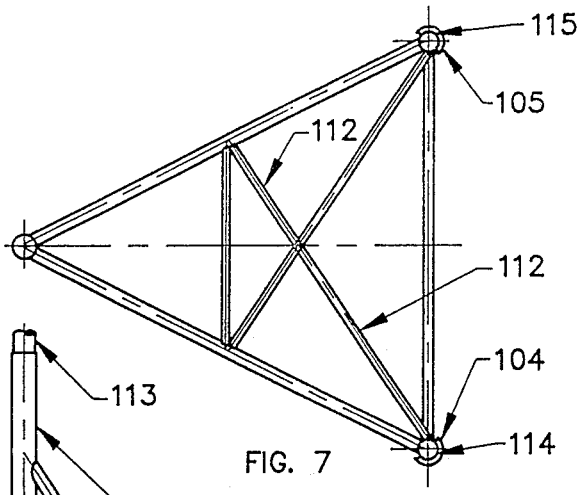
FIG. 7 is a top view of the offshore support structure of FIG. 5.
Figure 6:
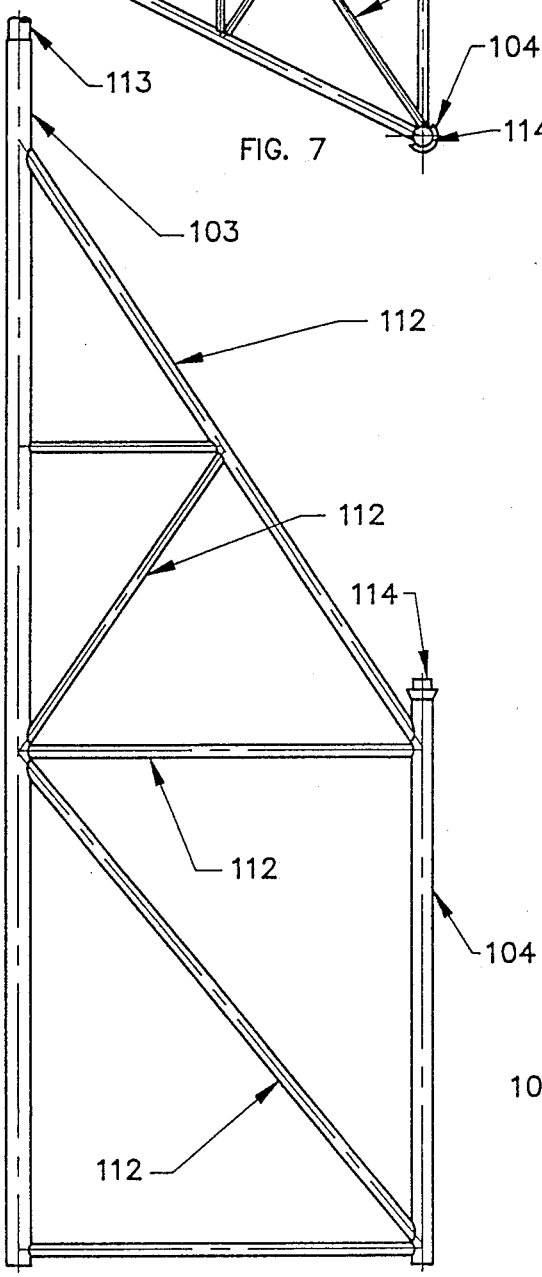
FIG. 6 is a side view of the offshore support structure of FIG. 5.
Figure 8:
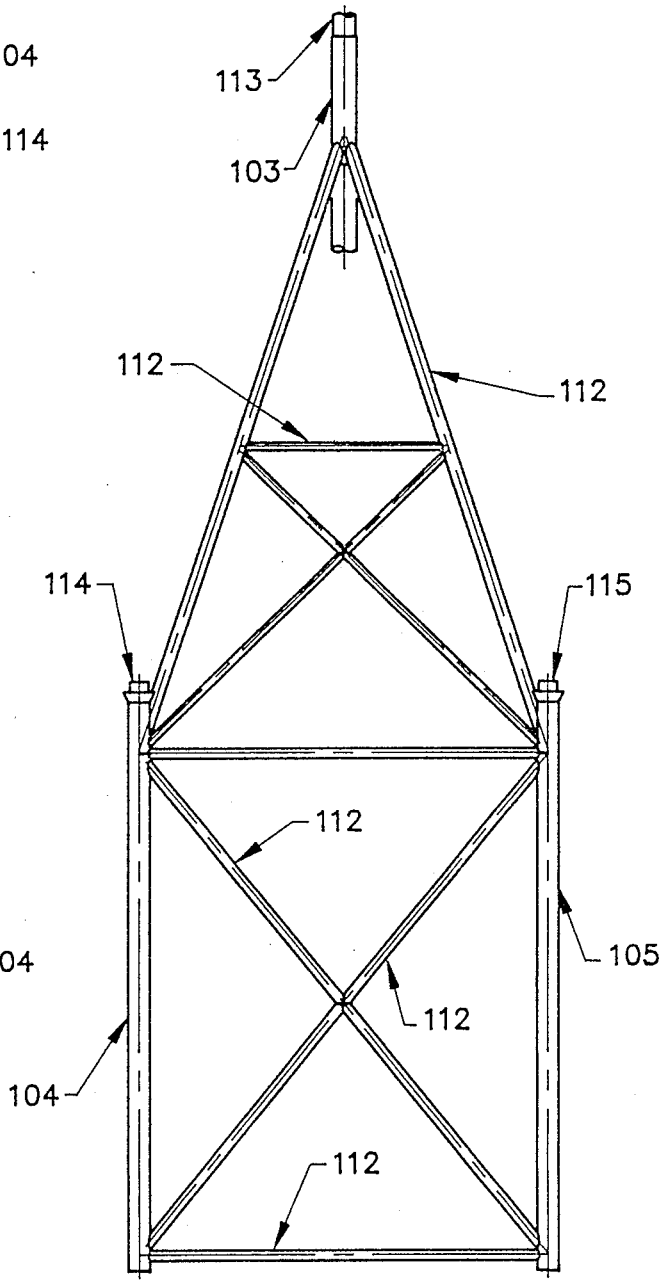
FIG. 8 is a rear view of the offshore support structure of FIG. 5.

With reference to FIGS. 1 and 5, a method for installing a platform structure 120 for use with at least one well 101 in a body of water 102 will be described. In a conventional manner, such as by barge, offshore support structures 100 or 100' are transported to their desired location in the body of water 102. In a conventional manner, support structure 100, or 100', is lowered to the ground 116 beneath the body of water 102, whereby the lower ends 109-111 of the legs 103–105, or 103'–105', rest upon the ground 116 as shown in FIGS. 1 AND 5. The upper end 106 of only one tubular leg 103, 103' extends above the surface of the water 102 as illustrated in FIGS. 1–5. A single hollow pile 113, 113' is driven through the tubular leg 103, 103' extending above the surface of the body of water 102, and the lower end 118 of the pile 113, 113' is driven into the ground 116 beneath the body of water 102. In this regard, hollow piles 113, 113' may be either preinstalled within hollow pile 113, 113' or it may be lowered into tubular leg 103, 103' in a conventional manner. A single pile 114, 115 or 114', 115' may then be driven in a conventional manner through legs 104, 105 or 104", 105' in a conventional manner. Preferably, piles 114, 115 or 114", 115' are pre-assembled and lowered within legs 104, 105 or 104", 105".

Still with reference to FIGS. 1 land 5, as previously described, the upper end 117 of the hollow pile 113, 113", is disposed to extend outwardly and upwardly from the upper end 106 of the tubular leg 103, 103' through which the hollow pile 113, 113' has been driven. The hollow pile 113, 113' is then fixedly secured to the tubular leg 103, 103", through which the hollow pile 113, 113' has been driven, in the manner previously described. Likewise, piles 114, 115 or 114", 115' may preferably be secured to legs 104, 105 or 104", 105' in the manner previously described, such as by grouting. As previously described, wells may be drilled through the hollow pile 113, 113' or platform structure 120 may be secured to the upper end of the hollow pile 113, 113", and a well subsequently drilled through hollow pile 113, 113". Likewise, additional wells may be provided through use of the tubular guides 121, as previously described in connection with FIG. 1.

When compared with previously proposed prior art offshore structure methods and apparatus, the offshore structures 100 and 100' of the present invention have the following advantages. Wave loads on the structures 100, 100' are reduced in that the surface area upon which the water 102 acts is much smaller, in that only the upper end of the hollow pile 113, 113' is acted upon by higher wave pressures. Because the wave load are reduced, the cost of the structure 100, 100' is reduced in that the structure 100, 100", can be lighter and thus use less steel in its construction. The piling requirements of structures 100 and 100' are also less than other types of offshore support structures, in that the piles 114, 115 and 114", 115' are shorter than those conventionally used, and these piles 114, 115, 114", 115", can be preinstalled as previously described. Since the structures 100, 100' are lighter in weight than conventional, prior art offshore support structures, additional savings can be obtained because the mud mats 125 can be made smaller, because less weight is being supported. Additionally, it is easier for a jack-up rig to be maneuvered adjacent the support structure, because there are no braces on one side of the structure 100 or 100". Furthermore, since the structures 100 or 100' are lighter, savings can be obtained through the use of a smaller derrick barge for the installation procedure.

It should be noted that the support structures 100, 100' of the present invention may also be utilized in connection with previously drilled wells in offshore locations, wherein the well has been drilled and a conductor pipe extends above the ground 116. In these situations, typically four to ten feet of conductor pipe (not shown) is left extending above the ground 116, until it is desired for production operations to begin. The structures 100, 100' of the present invention may be utilized in connection with such previously drilled wells, bu providing the lower end 109 of leg 103, 103", with a tubular guide 121, the tubular guide 121 being inverted from the position shown in FIGS. 1 and 5. Thus, as offshore support structures 100, 100' are lowered to the ground 116 beneath the body of water 102, the pre-existing conductor pipe can be mated with the inverted tubular guide 121, whereby offshore support structure 100, 100", would be located above the desired location where it is desired to drill additional wells.

It is to be understood that the invention is not limited to the exact details of construction, operation, exact materials or embodiments shown and described, as obvious modifications and equivalents will be apparent to one skilled in the art; for example, different bracing member configurations could be utilized or the support structure could be used without a well, such as for the support of a production facility. Accordingly, the invention is therefore to be limited only by the scope of the appended claims.

I claim:

1. An offshore support structure for use with at least one well located in a body of water, comprising:

only three tubular legs, each leg having upper and lower ends, a first leg having a length longer than the depth of the body of water, and the upper end of the first leg is adapted to be disposed above the surface of the body of water, the second and third legs each having substantially the same length, which length is shorter than the depth of the body of water;

a single pile disposed in each of the legs and adapted to be driven into the ground below the body of water, the pile disposed in the first leg being a hollow pile having an upper and a lower end and extending outwardly and upwardly from the first leg and being fixedly secured thereto;

a plurality of bracing members disposed between and interconnecting the three tubular legs; and the at least one well is disposed within the hollow pile disposed in the first leg, whereby the only portion of the support structure subject to the action of waves on the surface of the body of water is the upper end of the first leg and the hollow pile disposed in the first leg becomes part of the support structure and is capable of withstanding lateral and axial loads exerted upon the support structure.

2. The support structure of claim 1 wherein a platform structure is secured to the upper end of the hollow pile disposed in the first leg.

3. The support structure of claim 1, wherein a plurality of tubular guides are disposed in a spaced relationship outside of, and along, the length of the first leg, whereby additional wells may be placed in the ground below the body of water.

4. The support structure of claim 1, wherein a mud mat is disposed adjacent the lower end of each leg.

5. A method for installing a platform structure for use with at least one well located in a body of water, comprising the steps of:

lowering a support structure to the ground beneath the body of water at a desired location in the body of water, the support structure having only three interconnected tubular legs, each leg having upper and lower ends;

disposing the support structure in the body of water with only the upper end of one tubular leg extending above the surface of the body of water;

driving a single hollow pile, having upper and lower ends, through the tubular leg extending above the surface of the body of water and into the ground beneath the body of water, and driving a single pile through the other two tubular legs and into the ground beneath the body of water, which two legs have their upper ends disposed below the surface of the body of water;

disposing the upper end of the hollow pile to extend outwardly and upwardly from the upper end of the tubular leg through which the hollow pile has been driven;

fixedly securing the hollow pile to the tubular leg through which the hollow pile has been driven; and securing the platform structure to the upper end of the hollow pile, whereby the hollow pile becomes part of the support structure and is capable of withstanding lateral and axial loads exerted upon the support structure, and the only portion of the support structure subject to the action of waves on the surface of the body of water is the upper end of the leg containing the hollow pile and the upper end of the hollow pile.

6. The method of claim 5, including the step of drilling a well through the hollow pile.

7. The method of claim 5, including the steps of disposing a plurality of tubular guides in a spaced relationship outside of and along the tubular leg which extends above the surface of the body of water; disposing a hollow pile through the tubular guide; and drilling a well through the hollow pile.

8. The method of claim 5, including the step of disposing a mud mat adjacent the lower end of each tubular leg.

* * * * *